US011468862B2

(12) United States Patent
Huang

(10) Patent No.: US 11,468,862 B2
(45) Date of Patent: Oct. 11, 2022

(54) DRIVE CIRCUIT AND METHOD FOR DISPLAY APPARATUS

(71) Applicant: HKC Corporation Limited, Shenzhen (CN)

(72) Inventor: Xiaoyu Huang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 131 days.

(21) Appl. No.: 16/333,701

(22) PCT Filed: Nov. 21, 2018

(86) PCT No.: PCT/CN2018/116594
§ 371 (c)(1),
(2) Date: May 14, 2020

(87) PCT Pub. No.: WO2020/093448
PCT Pub. Date: May 14, 2020

(65) Prior Publication Data

US 2021/0358445 A1 Nov. 18, 2021

(30) Foreign Application Priority Data

Nov. 9, 2018 (CN) ..... 201811331477.2

(51) Int. Cl.
*G09G 3/36* (2006.01)

(52) U.S. Cl.
CPC ..... *G09G 3/3696* (2013.01); *G09G 3/3614* (2013.01); *G09G 2310/08* (2013.01)

(58) Field of Classification Search
CPC ..... G09G 2310/08; G09G 2330/02; G09G 2330/04
See application file for complete search history.

(56) References Cited

U.S. PATENT DOCUMENTS 5,495,190 A * 2/1996 Abe ..... G11C 7/22 327/19
5,726,677 A * 3/1998 Imamura ..... G09G 5/395 345/99
5,900,856 A * 5/1999 Iino ..... G09G 3/3692 345/100
5,903,103 A * 5/1999 Garner ..... A43B 3/34 36/137
10,621,905 B2 * 4/2020 Chen ..... H02J 4/00
10,726,805 B2 * 7/2020 Huang ..... G09G 3/3614
(Continued)

*Primary Examiner* — Van N Chow
(74) *Attorney, Agent, or Firm* — Juan Carlos A. Marquez; Marquez IP Law Office, PLLC

(57) ABSTRACT

A drive circuit for a display apparatus includes: a switching module, including a first input end, a second input end, a control end, and an output end, where the first input end obtains a first signal, the second input end obtains a second signal, the output end is connected to a pixel electrode, the control end obtains a control signal, the switching module selectively outputs the first signal and the second signal to the output end according to a level change of the control signal; and a controller, connected to the control end, and including a first end and a second end, where the first end obtains a first input signal, the second end obtains a second input signal, and the controller outputs the first input signal according to a period change of the second input signal, to serve as the control signal.

11 Claims, 6 Drawing Sheets

(56) References Cited

U.S. PATENT DOCUMENTS

| | | | | |
|---|---|---|---|---|
| 2014/0078129 | A1* | 3/2014 | Hong | G09G 5/00 345/212 |
| 2015/0002407 | A1* | 1/2015 | Knausz | H02M 1/44 345/173 |
| 2015/0022252 | A1* | 1/2015 | Venas | H03K 3/012 327/225 |

* cited by examiner

DRIVE CIRCUIT AND METHOD FOR DISPLAY APPARATUS

This application claims priority to Chinese Patent Application No. CN 201811331477.2, filed with the Chinese Patent Office on Nov. 9, 2018 and entitled "Drive Circuit And Method For Display Apparatus", which is incorporated herein by reference in its entirety.

TECHNICAL FIELD

This application relates to the display field, and in particular, to a drive circuit and method for a display apparatus.

BACKGROUND

A thin film transistor liquid crystal display (TFT-LCD) is one main type of current flat-panel displays, and has advantages of low costs, low power consumption, and high performance. The TFT-LCD are widely applied to fields such as electronic and digital products, and have become important display platforms in modern video products. A main drive principle of the TFT-LCD is that a system mainboard connects an R/G/B compression signal, a control signal, and power to a connector on a printed circuit board (PCB) by using a wire. After data is processed by an integrated circuit of a timing controller (TCON) on the PCB, the data passes through the PCB, and is connected to a display area by using a source thin-film driving chip and a gate thin-film driving chip, so that an LCD obtains a power supply signal.

In a conventional architecture, in display of liquid crystal panel, liquid crystal deflection is determined by a voltage difference between a voltage at a pixel electrode on an array substrate and a reference voltage on a color filter (CF) side, and brightness of transmitted light is finally determined. A larger voltage difference indicates a brighter picture. When a system is turned on, a picture is preset to black, that is, the voltage at the pixel electrode is the same as the reference voltage. In this case, the reference voltage on the CF side does not reach a preset voltage value yet. However, the timing controller already starts performing output, resulting in an abnormal picture.

SUMMARY

To resolve the foregoing problem, an objective of this application is to provide a drive circuit and method for a display apparatus.

The objective of this application is achieved and the technical problem of this application is resolved by using the following technical solutions. A drive circuit for a display apparatus provided in this application comprises: a switching module, comprising a first input end, a second input end, a control end, and an output end, wherein the first input end obtains a first signal, the second input end obtains a second signal, the output end is connected to a pixel electrode, the control end obtains a control signal, the switching module selectively outputs the first signal and the second signal to the output end according to a level change of the control signal; and a controller, connected to the control end, and comprising a first end and a second end, wherein the first end obtains a first input signal, the second end obtains a second input signal, and the controller outputs the first input signal according to a period change of the second input signal, to serve as the control signal.

In an embodiment of this application, the control signal is a first level, and the switching module outputs the first signal to the output end.

In an embodiment of this application, the control signal is a second level, and the switching module outputs the second signal to the output end.

In an embodiment of this application, the first level is a high level, and the second level is a low level.

In an embodiment of this application, the first level is a low level, and the second level is a high level.

In an embodiment of this application, the switching module comprises a first switch and a second switch, a first pole of the first switch is the first input end, a first pole of the second switch is the second input end, a second pole of the first switch and a second pole of the second switch are connected to each other, to serve as the output end, and a third pole of the first switch and a third pole of the second switch have opposite polarities and are connected to each other, to serve as the control end.

In an embodiment of this application, the third pole of the first switch has a positive polarity, and the third pole of the second switch has a reversed polarity.

In an embodiment of this application, the third pole of the first switch has a reversed polarity, and the third pole of the second switch has a positive polarity.

In an embodiment of this application, the first signal is a source voltage or gate voltage, and the second signal is a reference voltage.

In an embodiment of this application, the controller is a data flip flop, and when the second input signal is a rising edge, the data flip flop outputs the first input signal to serve as the control signal.

In an embodiment of this application, the first input signal is a high level voltage, and the second input signal is a clock pulse signal.

In an embodiment of this application, the first switch, the second switch, and the data flip flop are all located in a fanout area.

In an embodiment of this application, the high level voltage is a Voltage Drain Drain (VDD).

In an embodiment of this application, the first switch and the second switch are transistor switches.

In an embodiment of this application, the drive circuit comprises a resistor. A first connector of the resistor is connected to the third pole of the first switch and the third pole of the second switch, and a second connector of the resistor is connected to a low level voltage or is grounded.

In an embodiment of this application, when the source voltage is output to the output end, the display apparatus performs display normally.

In an embodiment of this application, when the reference voltage is output to the output end, the display apparatus displays a black picture.

The objective of this application may be further achieved and the technical problem of this application may be further resolved by using the following technical solutions.

Another objective of this application is to provide a drive method for a display apparatus, comprising: receiving a second input signal by using a controller, and outputting a first input signal according to a period change of the second input signal, to serve as a control signal; and receiving the control signal by using a switching module, and selectively outputting a first signal or a second signal to an output end according to a potential change of the control signal, wherein the first input signal is a level voltage signal, and the second input signal is a clock pulse signal.

In an embodiment of this application, the clock pulse signal is a low level or an empty signal, and the control signal is a first level.

In an embodiment of this application, when the clock pulse signal is a rising edge, the control signal is a second level.

In an embodiment of this application, the control signal is a first level, and the switching module outputs the first signal to the output end.

In an embodiment of this application, the control signal is a second level, and the switching module outputs the second signal to the output end.

Still another objective of this application is to provide a drive circuit for a display apparatus, comprising: a data flip flop, wherein a first end of the data flip flop obtains a high level voltage, and a second end of the data flip flop transmits a clock pulse signal; a first switch and a second switch, wherein a first pole of the first switch obtains a source voltage, a first pole of the second switch obtains a reference voltage, a second pole of the first switch and a second pole of the second switch are connected to each other and are connected to a pixel electrode, a third pole of the first switch has a positive polarity, a third pole of the second switch has a reversed polarity, and the third pole of the first switch and the third pole of the second switch are connected to each other and are electrically coupled to a control signal; and a resistor, wherein a first connector is connected to the third pole of the first switch and the third pole of the second switch, and a second connector is connected to a low level voltage or is grounded, wherein the clock pulse signal is a low level or an empty signal, the control signal output by the data flip flop is an empty signal, the first switch is open, the second switch is closed, and the reference voltage is transmitted to the pixel electrode; and when the clock pulse signal is a rising edge, the data flip flop outputs the high level voltage to serve as the control signal, the first switch is closed, the second switch is open, and the source voltage is transmitted to the pixel electrode.

By using the drive circuit for a display apparatus provided in this application, an abnormal picture resulted from a difference between a voltage at the pixel electrode and a reference voltage can be avoided.

DETAILED DESCRIPTION

Figure 1:
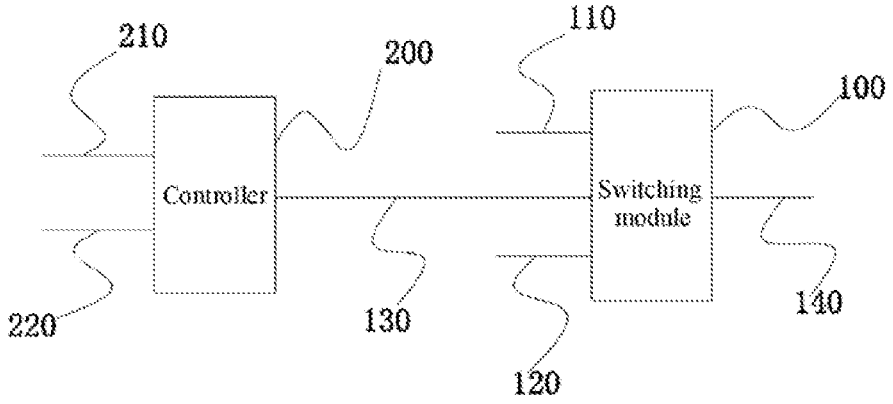
FIG. 1 is a schematic structural diagram of a drive circuit according to an embodiment of this application.

The following embodiments are described with reference to the accompanying drawings, to show examples of particular embodiments implemented by using this application. Direction-related terms provided in this application, for example, "above", "below", "front", "back", "left", "right", "inside", "outside", and "lateral face", merely refer to directions in the accompanying drawings. Therefore, the direction-related terms are used for the purpose of describing and understanding this application, and are not intended for limiting this application.

The accompanying drawings and the descriptions are considered as examples instead of limitation essentially. In the drawings, units having similar structures are represented by a same reference numeral. In addition, for ease of understanding and description, the size and the thickness of each component shown in the accompanying drawings are randomly selected, but this application is not limited thereto.

In addition, in the specification, unless otherwise explicitly described, the word "include" is understood as including the component, but excluding no other component. In addition, in the application, "on" means being located above or below a target component, but does not necessarily mean being located on the top based on a gravity direction.

To further describe the technical measures and functions used in the this application to achieve the predetermined objectives, specific implementations, structures, features, and functions of a drive circuit and method for a display apparatus provided in this application are described in detail below with reference to the accompanying drawings and specific embodiments.

FIG. 1 is a schematic structural diagram of a drive circuit according to an embodiment of this application. Referring to FIG. 1, a structure of a drive circuit includes: a switching module 100, where the switching module 100 includes a first input end 110, a second input end 120, a control end 130, and an output end 140; and a controller 200, where the controller 200 includes a first end 210 and a second end 220.

In an embodiment of this application, the first input end 110 obtains a first signal, and the second input end 120 obtains a second signal.

In an embodiment of this application, the control end 130 obtains a control signal.

In an embodiment of this application, the output end 140 is connected to a pixel electrode.

In an embodiment of this application, the switching module 100 selectively outputs the first signal and the second signal to the output end 140 according to a level change of the control signal.

In an embodiment of this application, the controller 200 is connected to the control end 130.

In an embodiment of this application, the first end 210 obtains a first input signal.

In an embodiment of this application, the second end 220 obtains a second input signal.

In an embodiment of this application, the second input signal is a clock pulse signal, the controller 200 outputs the first input signal according to a period change of the clock pulse signal, to serve as the control signal.

Figure 2:
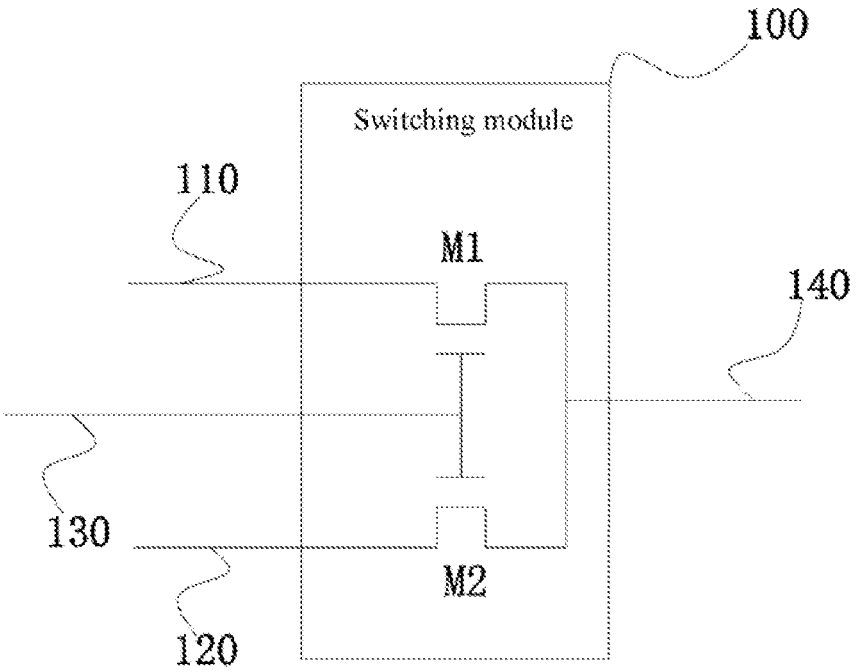
FIG. 2 is a schematic structural diagram of a switching module according to an embodiment of this application.

FIG. 2 is a schematic structural diagram of a switching module according to an embodiment of this application. Referring to FIG. 2, a structure of a switching module 100 includes: a first input end 110, a second input end 120, a control end 130, an output end 140, a first switch M1, and a second switch M2.

In an embodiment of this application, the first switch M1 and the second switch M2 are transistor switches.

In an embodiment of this application, a first pole of the first switch M1 is the first input end 110.

In an embodiment of this application, a first pole of the second switch M2 is the second input end 120.

In an embodiment of this application, a second pole of the first switch M1 and a second pole of the second switch M2 are connected to each other to serve as the output end 140.

In an embodiment of this application, a third pole of the first switch M1 and a third pole of the second switch M2 have opposite polarities, and are connected to each other to serve as the control end 130.

In an embodiment of this application, the third pole of the first switch M1 has a positive polarity, and the second switch M2 has a reversed polarity; or the third pole of the first switch M1 has a reversed polarity, and the second switch M2 has a positive polarity.

Figure 3:
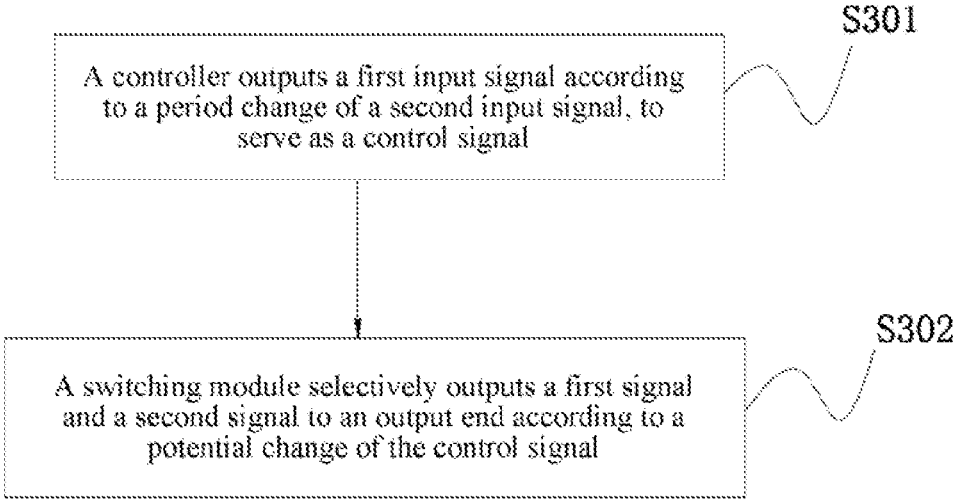
FIG. 3 is a schematic flowchart of a drive method according to an embodiment of this application.

FIG. 3 is a schematic flowchart of a drive method according to an embodiment of this application. Referring to FIG. 3, a procedure of a drive method includes the following steps:

Step S301. A controller outputs a first input signal according to a period change of a second input signal, to serve as a control signal.

Step S302. A switching module selectively outputs a first signal and a second signal to an output end according to a potential change of the control signal.

Figure 4:
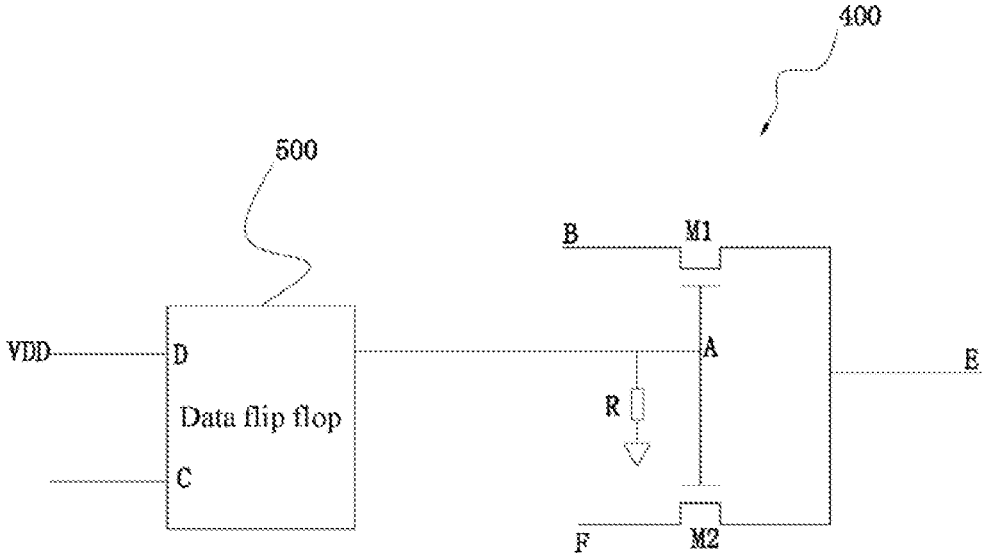
FIG. 4 is a diagram of an exemplary display apparatus according to an embodiment of this application.

FIG. 4 is a diagram of a drive circuit according to an embodiment of this application. A drive circuit 400 includes: a first switch M1, a second switch M2, a first pole B of the first switch M1, and a first pole F of the second switch M2, where the first switch M1 and the second switch M2 have a common second pole E and a common third pole A; a data flip flop 500, a first end D of the data flip flop 500, and a second end C of the data flip flop 500; and a resistor R.

In an embodiment of this application, the first switch M1 and the second switch M2 are transistor switches.

In an embodiment of this application, the third pole A of the first switch M1 and the second switch M2 is connected to the data flip flop 500.

In an embodiment of this application, a first connector of the resistor R is connected to the third pole A of the first switch M1 and the second switch M2, and a second connector of the resistor R is connected to a low level voltage or is grounded.

In an embodiment of this application, the second pole E of the first switch M1 and the second switch M2 is connected to a pixel electrode.

In an embodiment of this application, the first end D of the data flip flop 500 obtains a high level voltage VDD.

In an embodiment of this application, the second end C of the data flip flop 500 obtains a clock pulse signal.

In an embodiment of this application, the first pole B of the first switch M1 obtains a source voltage or a gate voltage.

In an embodiment of this application, the first pole F of the second switch M2 obtains a reference voltage.

In an embodiment of this application, the data flip flop 500 transmits the control signal to the third pole A of the first switch M1 and the second switch M2.

In an embodiment of this application, the clock pulse signal is a low level or an empty signal, the control signal output by the data flip flop 500 is an empty signal, the first switch M1 is closed, the second switch M2 is open, the reference voltage is transmitted to the pixel electrode, and in this case, a display displays a black picture.

In an embodiment of this application, when the second end C of the data flip flop 500 learns of the clock pulse signal being a rising edge, the data flip flop 500 outputs the high level voltage VDD of the first end D, as the control signal, to the third pole A of the first switch M1 and the second switch M2, the first switch M1 is open, the second switch M2 is closed, the source voltage is transmitted to the pixel electrode, and in this case, the display can perform display normally.

Figure 5:
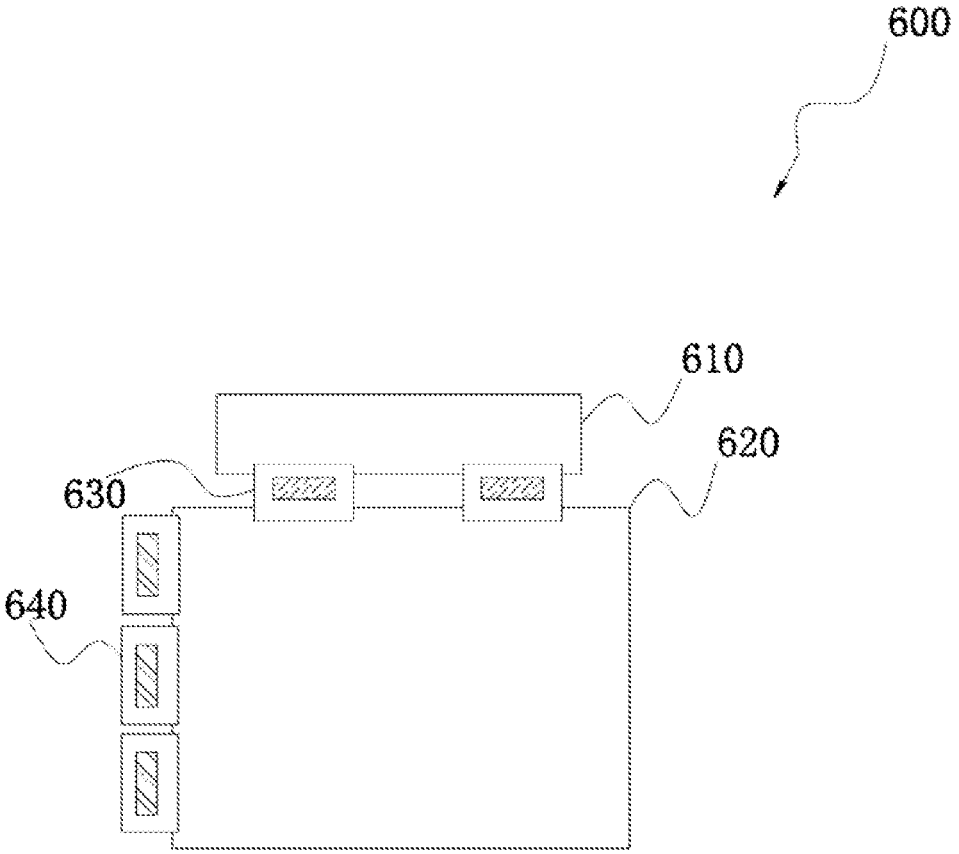
FIG. 5 is a diagram of a drive circuit according to an embodiment of this application.

FIG. 5 is a diagram of an exemplary display apparatus according to an embodiment of this application. Referring to FIG. 5, a display apparatus 600 includes: a PCB 610, a display panel 620, a source thin-film driving chip 630, and a gate thin-film driving chip 640.

Figure 6:
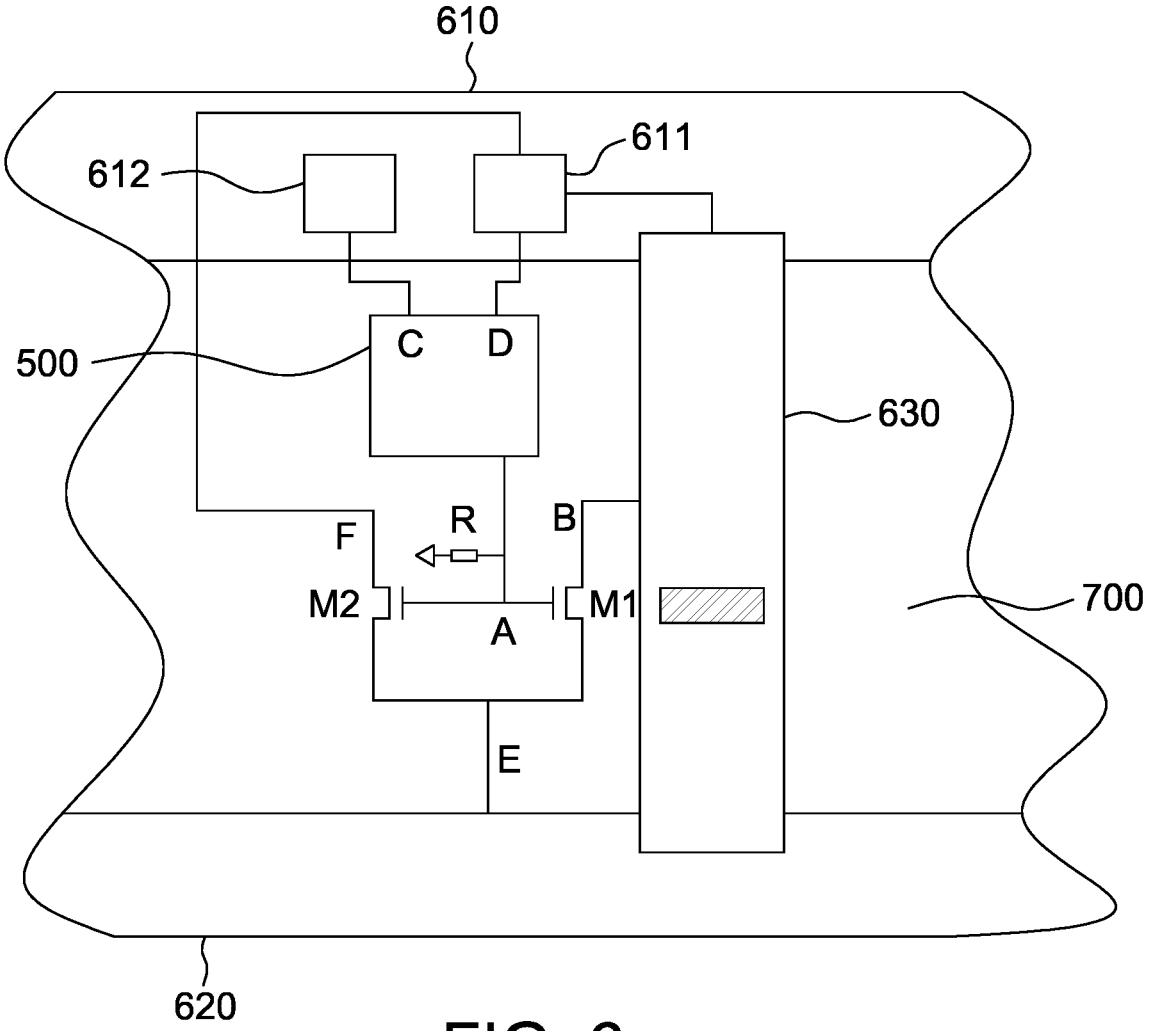
FIG. 6 is a diagram showing that a drive circuit is disposed in a display apparatus according to an embodiment of this application.

FIG. 6 is a diagram showing that a drive circuit is disposed in a display apparatus according to an embodiment of this application. Referring to FIG. 6, a drive circuit includes: a PCB 610, where the PCB includes a timing controller 612 and a voltage generation unit 611, a display panel 620, and a source thin-film driving chip 630; a first switch M1, a second switch M2, a first pole B of the first switch M1, and a first pole F of the second switch M2, where the first switch M1 and the second switch M2 have a common second pole E and a common third pole A; a data flip flop 500, a first end D of the data flip flop 500, and a second end C of the data flip flop 500; and a resistor R.

In an embodiment of the present invention, the drive circuit 400 is located in a fanout area 700 of the display apparatus 600.

In an embodiment of the present invention, the second end C of the data flip flop 500 is connected to the timing controller 612.

In an embodiment of the present invention, the timing controller 612 provides a clock pulse signal to the second end C of the data flip flop 500.

In an embodiment of the present invention, the first end D of the data flip flop 500 is connected to the voltage generation unit 611.

In an embodiment of the present invention, the voltage generation unit 611 provides a high level voltage VDD to the first end D of the data flip flop 500.

In an embodiment of the present invention, the first pole B of the first switch M1 is connected to the source thin-film driving chip 630.

In an embodiment of the present invention, the source thin-film driving chip 630 is connected to the voltage generation unit 611.

In an embodiment of the present invention, the voltage generation unit 611 supplies power to the source thin-film driving chip 630, and the source thin-film driving chip 630 provides a source voltage to the first pole B of the first switch M1.

In an embodiment of the present invention, the first pole F of the second switch M2 is connected to the voltage generation unit 611.

In an embodiment of the present invention, the voltage generation unit 611 provides a source voltage to the first pole F of the second switch M2.

In an embodiment of the present invention, the second pole E of the first switch M1 and the second switch M2 is connected to the display panel 620.

In some embodiments, the display panel 620 in this application may be, for example, a liquid crystal display panel, but is not limited thereto, and may alternatively be an organic light emitting diode (OLED) display panel, a white organic light emitting diode (W-OLED) display panel, a quantum dot light emitting diode (QLED) display panel, a plasma display panel, a curved-surface display panel, or another type of display panel.

Phrases such as "in some embodiments" and "in various embodiments" are used repeatedly. They usually do not refer to a same embodiment; but they may refer to a same embodiment. Terms such as "include", "have", and "comprise" are synonymous unless otherwise described in context.

Descriptions above are merely embodiments of this application, and are not intended to limit this application in any form. Although this application has been disclosed above in forms of specific embodiments, the embodiments are not intended to limit this application. A person skilled in the art can make some equivalent variations, alterations or modifications to the above disclosed technical content without departing from the scope of the technical solutions of the above disclosed technical content to obtain equivalent embodiments. Any simple alteration, equivalent change or modification made to the foregoing embodiments according to the technical essence of this application without departing from the content of the technical solutions of this application shall fall within the scope of the technical solutions of this application.

What is claimed is:

1. A drive circuit for a display apparatus, comprising:

a switching module, comprising: a first input end, a second input end, a control end, and an output end, wherein the first input end obtains a first signal, the second input end obtains a second signal, the output end is connected to a pixel electrode, the control end obtains a control signal, the switching module selectively outputs the first signal and the second signal to the output end according to a level change of the control signal; and a controller, connected to the control end, and comprising a first end and a second end, wherein the first end obtains a first input signal, the second end obtains a second input signal, the second input signal is a clock pulse signal, the controller outputs the first input signal according to a period change of the clock pulse signal, to serve as the control signal;

wherein the controller is a data flip flop, and when the clock pulse signal is a low level or an empty signal, the control signal output by the data flip flop is an empty signal, the first switch is open, the second switch is closed, and the reference voltage is transmitted to the pixel electrode; and the controller is a data flip flop, and when the clock pulse signal is a rising edge, the data flip flop outputs the high level voltage to serve as the control signal, the first switch is closed, the second switch is open, and the source voltage is transmitted to the pixel electrode.

2. The drive circuit for a display apparatus according to claim 1, wherein the control signal is a first level, and the switching module outputs the first signal to the output end.

3. The drive circuit for a display apparatus according to claim 2, wherein the control signal is a second level, and the switching module outputs the second signal to the output end.

4. The drive circuit for a display apparatus according to claim 3, wherein the first level is a high level, and the second level is a low level.

5. The drive circuit for a display apparatus according to claim 3, wherein the first level is a low level, and the second level is a high level.

6. The drive circuit for a display apparatus according to claim 1, wherein the switching module comprises a first switch and a second switch, a first pole of the first switch is the first input end, a first pole of the second switch is the second input end, a second pole of the first switch and a second pole of the second switch are connected to each other, to serve as the output end, and a third pole of the first switch and a third pole of the second switch are connected to each other, to serve as the control end.

7. The drive circuit for a display apparatus according to claim 6, wherein the third pole of the first switch has a positive polarity, and the third pole of the second switch has a reversed polarity.

8. The drive circuit for a display apparatus according to claim 6, wherein the third pole of the first switch has a reversed polarity, and the third pole of the second switch has a positive polarity.

9. The drive circuit for a display apparatus according to claim 6, wherein the first switch and the second switch are transistor switches.

10. The drive circuit for a display apparatus according to claim 1, wherein the first signal is a source voltage or gate voltage, and the second signal is a reference voltage.

11. The drive circuit for a display apparatus according to claim 1, wherein the first input signal is a high level voltage.

* * * * *